US006308849B1

(12) United States Patent
Kim

(10) Patent No.: US 6,308,849 B1
(45) Date of Patent: Oct. 30, 2001

(54) CAP FOR CONTAINERS USED ON DRINKING WATER DISPENSERS

(76) Inventor: Charles Y. J. Kim, #317-511 West 7th Ave., Vancouver, BC (CA), V5Z 4R2

( * ) Notice: Subject to any disclaimer, the term of this patent is extended or adjusted under 35 U.S.C. 154(b) by 0 days.

(21) Appl. No.: 09/373,674

(22) Filed: Aug. 13, 1999

(51) Int. Cl.[7] ..... B65D 51/00

(52) U.S. Cl. ..... 215/303; 215/253; 215/254; 220/229; 141/351; 141/364

(58) Field of Search ..... 215/250, 253, 215/254, 256, 296, 303; 220/229; 141/351–354, 364

(56) References Cited

U.S. PATENT DOCUMENTS 4,022,258 * 5/1977 Steidley ..... 215/250
4,874,023 * 10/1989 Ulm ..... 141/351
5,259,534 * 11/1993 Lynd ..... 141/364
5,687,867 * 11/1997 Lamoureux ..... 215/303
5,937,921 * 8/1999 Guglielmini ..... 215/303

* cited by examiner

*Primary Examiner*—Nathan J. Newhouse
(74) *Attorney, Agent, or Firm*—Robert W. Jenny

(57) ABSTRACT

The cap snaps onto the neck of a container used on a water dispenser and has an inner cylinder, which engages a probe in the dispenser when the container is installed on a dispenser. The end of the inner cylinder is closed by a membrane which is frangible and grooved such that the probe breaks the membrane into a plurality of petals which are displaced and deformed as the probe moves through the cap. The membrane extends into the inner cylinder and is turned inside out as the probe passes through. In a preferred embodiment the membrane has an outer rim, a first frusto-conical portion, a second rim, a second, smaller frusto-conical portion extending in a direction opposite the direction of the first frusto-conical portion and a flat end.

1 Claim, 1 Drawing Sheet

FIG. 1
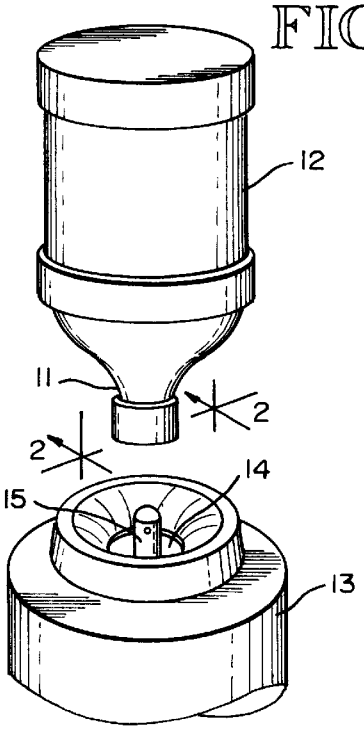
FIG. 2
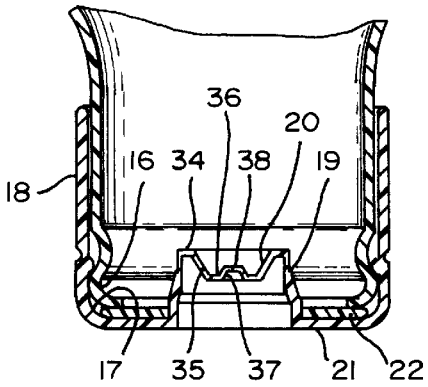
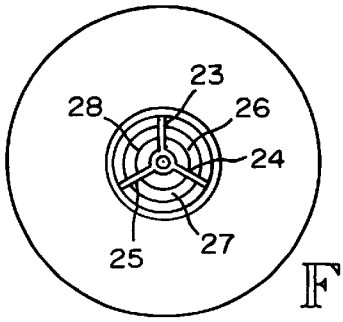
FIG. 3
FIG. 4
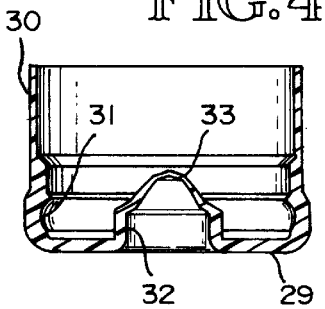
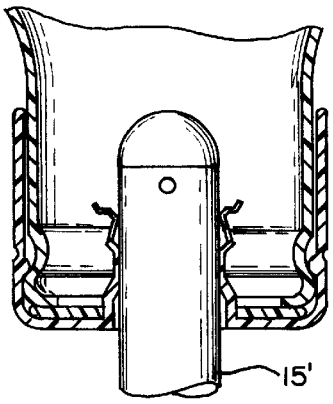
FIG. 5
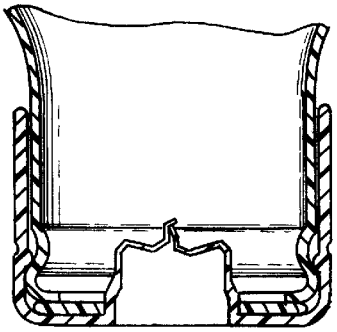
FIG. 6

CAP FOR CONTAINERS USED ON DRINKING WATER DISPENSERS

BACKGROUND OF THE INVENTION

1. Field

The subject invention is in the field of caps for containers for liquids, particularly caps for bottles which contain drinkable liquids and which are inverted when being installed on and removed from dispensers specifically designed to accommodate such containers. A typical and preferred container has a neck which, when the container is inverted fits into an opening in the top of the dispenser. A capped tube, known as a probe or liquid supply tube is part of the dispenser and, when a container is installed in the dispenser, extends upward into the neck of the container. Caps are commercially available for use on the necks of such containers to limit leakage while the container is being installed on and removed from the dispenser. Such caps have an outer cylindrical portion, which fits snugly over the neck and holds the cap in place and an inner cylindrical portion which engages the probe. The free end of the inner cylindrical portion is made closed, is opened as the probe passes through the inner cylindrical portion and closes again when the probe is removed from the inner cylindrical portion when the container is removed from the dispenser. The subject invention is an improved configuration of the opening/closing end of the inner cylinder of the type of cap described.

2. Prior Art

There are two basic types of caps made for the purpose described above: two part caps as typified by the cap described in U.S. Pat. No. 5,392,939, Hidding et al and one part caps as typified by the cap described in U.S. Pat. No. 5,687,867, Lamoureux. The subject cap is a one-piece cap and the Lamoureux patent is the closest known prior art to the subject invention. The free end of the inner cylinder of the Lamoureux cap is conical and frangible and projects out of the inner cylinder, termed the guiding portion in that patent. The Lamoureux end projects in the direction in which the probe moves through it when a container is installed on a dispenser. Experience has shown that the Lamoureux cap does not close as consistently and reliably as desired and allows tolerable but undesired leakage when a container still containing some liquid is removed from a dispenser. Accordingly, the primary objective of the subject invention is to provide, for containers used on drinking water dispensers, a cap having improved sealing capability when the container is removed from a dispenser.

SUMMARY OF THE INVENTION

The subject invention is a cap for containers used on drinking water dispensers. The cap prevents leakage when the container is being installed on and removed from a dispenser. The cup has the basic shape of a cylindrical cup and has an inner cylindrical portion extending into the cap from the closed end. The cylindrical wall of the cup is sized and shaped to fit on the neck of a container and engage features on the neck to hold the cap securely In place on the container. The inner cylinder is sized to fit closely on the probe of a liquid dispenser and its free end (i.e. its end away from the closed end of the cap) is closed off by a frangible portion and the subject invention lies in the configuration of the frangible portion. The frangible portion comprises a flat rim, a first frusto-conical portion extending into the cylindrical portion, a second rim, a second frusto-conical portion extending into the first frusto-conical portion and an end.

There are radial grooves in the frangible portion so that when it is broken open by contact with the probe of a dispenser it breaks predictably into a plurality of petals. The frangible portion is turned "inside out" when the probe extends through the cap and into the container. When the container is removed, the retraction of the probe from the cap tends to restore the frangible portion to its "right side out" configuration. However, the restoration is partial, with the petals pressed firmly against each other, providing a reliable, consistent seal. The partially restored petals tend to lie in a plane but bulge somewhat toward the container. The result of this is that the static pressure of liquid remaining in the container increases the contact pressures between the petals, reinforcing the sealing.

The invention is described in more detail below with reference to the attached drawings.

BRIEF DESCRIPTION OF THE DRAWINGS

FIG. 1 is a general view of the top of a water dispenser and an inverted container in position to be installed on the dispenser, the subject cap being installed on the container.

FIG. 2 is a semi-schematic sectional view taken at 2—2 in FIG. 1.

FIG. 3 is a view taken at 3—3 in FIG. 1.

FIG. 4 is a sectional view of the prior art cap disclosed in U.S. Pat. No. 5,687,867, Lamoureux.

FIG. 5 is a sectional view of the subject cap installed on the probe of a water dispenser.

FIG. 6 is a sectional view of the cap of the subject cap after being removed from the probe.

DETAILED DESCRIPTION OF THE INVENTION

The subject invention is a cap for containers used on drinking water dispensers. In FIG. 1 cap 10 is installed on neck 11 of inverted container 12, in position to be installed on water dispenser 13. Neck 11 of the container will be installed in opening 14 of the dispenser and probe 15 of the dispenser will penetrate the cap, as shown in FIG. 5 and explained below, allowing liquid in the container to flow into the dispenser.

FIG. 2 is a semi-schematic sectional view taken at 2—2 in FIG. 1, illustrating details of the cap and container neck. Flange 16 on the neck fits into groove 17 of the cap to retain the cap on the neck. Cylindrical skirt 18 of the cap serves to stabilize the cap on the neck against disturbing forces, which may be applied as the probe engages inner cylinder 19 of the cap and penetrates membrane 20. The inner cylinder is concentric with the cylindrical skirt and extends into the cup from closed end 21. Gasket 22 helps seal the liquid in the container.

FIG. 3 is a view of the cap taken from 3—3 in FIG. 2 and illustrates grooves 23, 24 and 25 in the membrane. The membrane is frangible, is broken by the penetration of the probe, and the grooves control and facilitate the breaking of the membrane into three petals 26, 27, and 28.

FIG. 4 is a sectional view of the prior art cap disclosed in U.S. Pat. No. 5,687,867, Lamoureux, as it is marketed. This cap 29 also comprises a skirt 30, groove 31, inner cylinder 32 and frangible membrane 33. The membrane is conical and, as shown and claimed in '867, projects from the inner cylinder. As shown in FIG. 2 the membrane of the subject cap projects into the inner cylinder and comprises a first rim 34, a first frusto-conical portion 35, a second rim 36, a second frusto-conical portion 37 and an end 38. The second, smaller frusto-conical portion extends in a direction opposite to the direction of the first frusto-conical portion.

FIG. 5 is a sectional view of the subject cap installed on the probe 15' of a water dispenser. The membrane is turned inside out as the probe moves through the cap. In the '867 cap the segments or petals of the membrane are simply spread apart as the probe moves through, without significant distortion. When the '867 cap is removed from the probe the forces tending to restore its membrane to its closed configuration are weak and the withdrawal of the probe does nothing to help that restoration. With the subject cap the distortion of the membrane is significant as it is turned inside out during the movement of the probe through the cap, as shown in FIG. 5, a sectional view of the subject cap installed on the probe of after dispenser. The withdrawal of the probe tends to drag the petals into their original state. Full restoration is impossible but, between (1) the effects of the physical memory of the plastic material of the cap and (2) the dragging by the probe, the petals are forced into secure closure as shown in FIG. 6, a sectional view of the subject cap after being removed from the probe, showing the petals deformed and at least in part overlapping one another. This conformation effectively prevents leakage of liquid remaining in the container when it is removed from the dispenser.

It is considered to be understandable from this description that the subject invention meets its objective. It provides, for containers used on drinking water dispensers, a cap having improved sealing capability when the container is removed from a dispenser.

It is also considered to be understood that while one embodiment of the subject invention is described herein, other embodiments and modifications of the one described are possible within the scope of the invention, which is limited only by the attached claims.

What is claimed is:

1. A cap for containers used on water dispensers, said cap having a closed end, a cylindrical skirt, and inner cylinder concentric with said skirt, extending into said cap from said closed end and having a free end and a membrane at said free end, said membrane extending into said inner cylinder, said membrane comprising a first rim, a first frusto-conical portion extending in a first direction into said inner cylinder, a second rim, a second frusto-conical portion extending in a direction opposite to said first direction and an end.

* * * * *